United States Patent [19]

Miller

[11] 4,095,722

[45] Jun. 20, 1978

[54] DRIPLESS DISPENSER AND METHOD OF DISPENSING A FLOWABLE MATERIAL

[76] Inventor: Kenneth L. Miller, 1230 Lawrence Rd., Carmel, Ind. 46032

[21] Appl. No.: 668,417

[22] Filed: Mar. 19, 1976

[51] Int. Cl.[2] ..... B65D 37/00

[52] U.S. Cl. ..... 222/1; 91/36; 222/207; 222/214; 222/108; 251/5; 251/7

[58] Field of Search ..... 222/207, 571, 109, 108, 222/424, 70, 212, 213, 214, 215; 251/5, 7, 61.1, 120; 91/36, 412

[56] References Cited

U.S. PATENT DOCUMENTS

| | | | |
|---|---|---|---|
| 1,799,113 | 3/1931 | Miedbrodt | 91/36 X |
| 2,673,011 | 3/1954 | Rood et al. | 222/207 |
| 3,245,269 | 4/1966 | Ivig | 251/7 X |
| 3,550,619 | 12/1976 | Halasz et al. | 251/7 X |
| 3,895,748 | 7/1975 | Klingenberg | 222/507 |
| 3,937,440 | 2/1976 | MacGregor et al. | 222/571 X |
| 3,998,103 | 12/1976 | Björklund et al. | 222/215 X |
| 4,042,153 | 8/1977 | Callahan et al. | 222/207 |

*Primary Examiner*—Allen N. Knowles
*Assistant Examiner*—Fred A. Silverberg

[57] ABSTRACT

A flowable material dispenser having a bore therethrough. A resilient pinch-off tube is removably fitted within the bore. A flowable material reservoir is connected to one end of the tube. At least one dispensing nozzle or needle is coupled to the other end of the tube. Within the dispenser is a mechanism for selectively squeezing the tube to force selected amounts of the flowable material out the needle, and then to draw any residual amount of the material in the needle back away from the distal end of the needle thereby to eliminate dripping. Connected to the squeezing mechanism is a control system for sequencing the squeezing operation to perform the method of the invention which includes the steps of filling the tube with material, isolating a portion of the material in the tube from the reservoir, dispensing a portion of the isolated material, drawing the remaining portion of the isolated material in the needle back away from the distal end of the needle, and refilling the tube with material.

18 Claims, 8 Drawing Figures

205
10
6
14

205
10
6
14

202
201
8
204
206
10
74
6
30
14
208
32
22
218
34
36
210
28
222
16
20
26
220
58
66
124
124
160
67
43
108
68
70
90
38
102
224
56
86
92
104
50
118
3
15
115
72
106
226
3
44
110
194
136
142
24
124
212
112
134
85
46
209
123
84
42
48
114
128
196
4
4
78
40
12
125
138
61
124
166
140
198
80
98
120
88
200
117
96
154
144
54
52
158
123
119
122
170
76
116
162
172
150
148
130
152
146
123
174
132
123
2

DRIPLESS DISPENSER AND METHOD OF DISPENSING A FLOWABLE MATERIAL

BACKGROUND OF THE INVENTION

In the past the deposition of adhesives, sealants, lubricants and the like has been plagued by many problems. In the absence of any type of a mechanical dispenser, the application of such materials is more often than not a messy and inaccurate operation. Frequently, an expensive substance is haphazardly applied, wasting valuable material and generating unnecessary clean-up costs. Even the use of one of the many types of dispensers heretofore known to those skilled in the art has failed to eliminate all of the problems. While many of these dispensing devices may dispense certain materials accurately, they are still not capable of producing uniform shots of a flowable material, the viscosity of which is subject to change, a common phenomenon in flowable materials such as epoxy resin adhesives. Nor can they accommodate a variety of materials having a wide range of viscosities. Conventional dispensers may reduce the wastage of material, but the necessary periodic readjustments of these dispensing devices produces undesirable "down-time", crating inefficiencies in a common production process situation. Maintenance and changeover of materials is also commonly time consuming and costly. Furthermore, many of the dispenser heretofore available are susceptible to undesirable dripping of material from the dispensing nozzle after dispensing the desired amount of material.

It would therefore be desirable to have an improved flowable material dispenser that operates with continual accuracy despite changing viscosities of materials, accommodates a wide range of viscosities, reduces maintenance and changeover costs, eliminates post-dispensing drippage, and provides a more efficient and dependable method for dispensing shots of flowable materials.

SUMMARY OF THE INVENTION

It is therefore an object of the invention to provide an improved flowable material dispenser.

It is another object of the invention to provide a dripless flowable material dispenser.

It is another object of the invention to provide an improved and more accurate shot dispenser.

It is another object of the invention to provide an improved shot dispenser capable of dispensing selected volumes of a flowable material varying from a fraction of a drop to 15 drops.

It is still another object of the invention to provide an improved dispenser constructed in such a manner that maintenance and material changeover is facilitated.

It is still another object of the invention to provide an improved shot dispenser which requires a mininum of readjustment during operation.

It is still another object of the invention to provide a dispenser which is useful with materials having a wide range of viscosities for example, a range of about 10 to about 200,000 cps.

It is still another object of the invention to provide an improved method of dispensing a flowable material.

It is further an object of the invention to provide an improved method of dispensing which eliminates the dripping of a material after the dispensing thereof.

It is still further an object of the invention to provide an improved flowable material dispenser and method by which uniformly sized shots can be continuously dispensed despite the changing of the viscosity of the particular material being dispensed.

In the broader aspects of the invention, there is provided a positive displacement flowable material dispenser having a bore therethrough and a resilient pinch-off tube removably fitted within the bore. A reservoir for supplying material to the tube is connected to one end of the tube. At least one dispensing nozzle or needle is removably coupled to the other end of the tube. The dispenser head includes a mechanism for squeezing the pinch-off tube to force selected amounts of a flowable material out the dispensing needle and drawing any residual amount of material in the needle back away from the distal end thereof to prevent dripping. Connected to the squeezing mechanism is a system for controlling and sequencing the squeezing process to perform the method of the invention. The method of the invention comprises the steps of filling the tube with material, isolating a portion of the material in the tube from the reservoir, dispensing a portion of the isolated material, drawing the residual portion of the isolated material remaining in the needle back away from the distal end of the needle, and refilling the tube with material.

BRIEF DESCRIPTION OF THE DRAWINGS

The above mentioned and other features and objects of this invention and the manner of attaining them will become more apparent and the invention itself will be best understood by reference to the following description of an embodiment of the invention taken in conjunction with the accompanying drawings, wherein.

DESCRIPTION OF THE SPECIFIC EMBODIMENT

Figures 1, 1A, 1B:
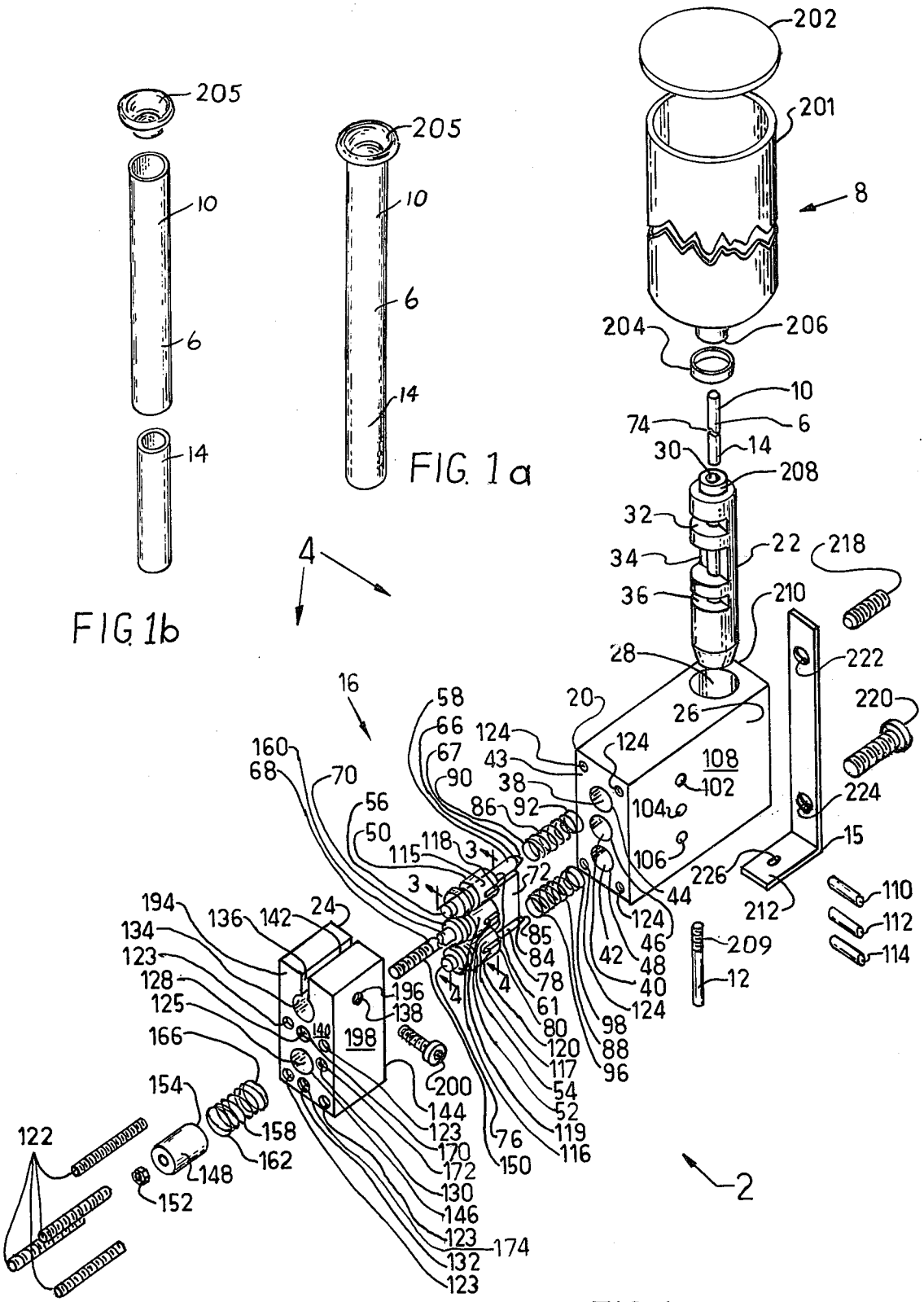
FIG. 1 is a perspective and exploded view of the improved flowable material dispenser of the invention.
FIGS. 1*a* and 1*b*, respectively, are enlarged perspective views of two embodiments of the pinch off tube used with the dispenser shown in FIG. 1, FIG. 1*b* being exploded.

Referring to the drawings, the improved flowable material dispenser 2 of the invention is shown. Dispenser 2 comprises a dispenser head 4, a resilient pinch-off tube 6, a flowable material reservoir 8 coupled to the upper end 10 of pinch-off tube 6, a dispensing nozzle or needle 12 coupled to the lower end 14 of tube 6, a pinch-off tube guide 15, squeezing mechanism 16 for forcing specified amounts of a flowable material out of pinch-off tube 6 and needle 12, and a control system 18 for sequencing squeezing mechanism 16.

Figure 2:
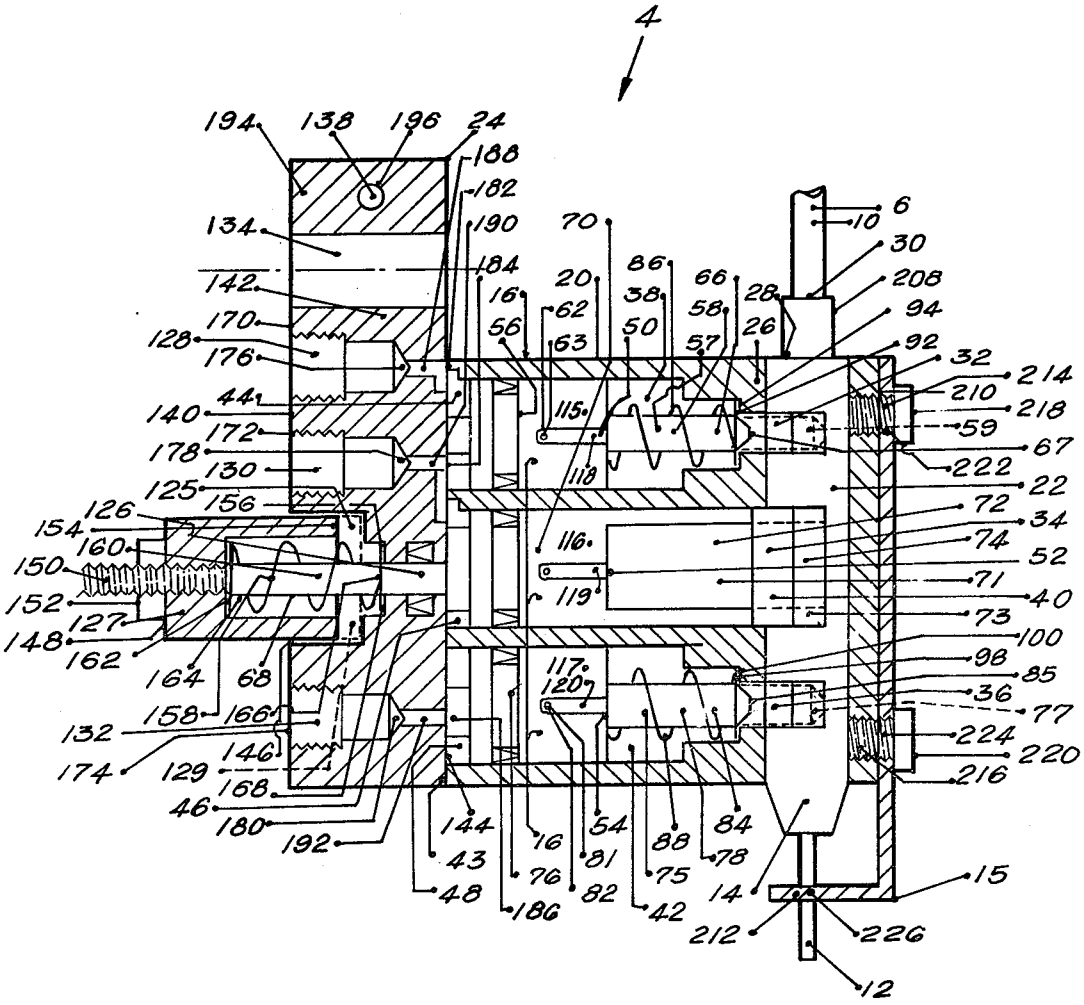
FIG. 2 is a fragmentary side view of the dispenser head, partly in cross-section, showing the assembly of the components of the dispenser head illustrated in FIG. 1.

Dispenser head 4 is shown in FIGS. 1 and 2 to include a body 20, a pinch-off head 22 and a base 24. Body 20 can be made of any solid, durable, and machinable structural material; in a specific embodiment, body 20 is made of aluminum. Extending vertically through one end 26 of body 20 is a bore 28 through which pinch-off head 22 is removably fitted. Extending axially through the entire length of pinch-off head 22 is a bore 30 for receiving and holding resilient pinch-off tube 6. Pinch-off head 22 also has side openings 32, 34 and 36 to accommodate the operation of squeezing mechanism 16 on pinch-off tube 6. Pinch-off head 22 can be made of any solid, cylindrical, and machinable structural material. In a specific embodiment, pinch-off head 22 is made of stainless steel.

Dispenser head body 20 also has formed therein cylinders 38, 40, and 42 for housing squeezing mechanism 16. Cylinders 38, 40, and 42 extend within body 20 from surface 43 of body 20 to bore 28, intersecting pinch-off head 22 at side openings 32, 34 and 36, respectively, generally perpendicularly thereto. Access to cylinders 38, 40, and 42 is by way of openings 44, 46, and 48 respectively, in surface 43 of body 20. Upper pinch-off piston 50, intermediate displacement dispensing piston 52, and lower pinch-off piston 54 are slidably fitted within cylinders 38, 40, and 42, respectively, of dispenser head body 20.

Figure 3:
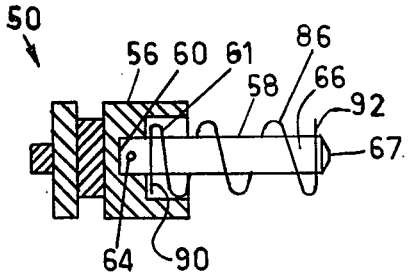
FIG. 3 is a cross-sectional view of the top pinch-off piston of the dispenser taken substantially along the section line 3—3 in FIG. 1.

Upper pinch-off piston 50 includes a base 56 and a plunger 58. Piston 50 is movable along the axis of cylinder 38 from a position 57 in which plunger 58 is positioned within cylinder 38 to a position 59 in which plunger 58 of piston 50 extends through opening 32 of pinch-off head 22 to compress the upper end 10 of pinch-off tube 6. As best seen in FIG. 3, plunger 58 has a blunt end 60 removably secured within the hollow portion 61 of base 56 by a pin 62 inserted in hole 63 of base 56 and hole 64 of plunger 58 so that plunger 58 is interchangable and replacable in base 56. The other end 66 of pluner 58 has a wedged shaped ram 67. The width of ram 67 is chosen such that by forcing ram 67 of plunger 58 against pinch-off tube 6, the flow of material from reservoir 8 into pinch-off tube 6 is completely stopped. Both base 56 and plunger 58 can be made of any machinable structural material. In a specific embodiment base 56 is made of aluminum, and plunger 58 is made of stainless steel.

Intermediate displacement dispensing piston 52 includes a shaft 68, a base 70, and a displacement ram 72. Piston 52 is movable along the axis of cylinder 40 from a position 71 in which ram 72 is positioned within cylinder 40 to a position 73 in which ram 72 extends through opening 34 of pinch-off head 22 to compress the middle portion 74 of pinch-off tube 6, thereby forcing a portion of the flowable material in tube 6 out dispensing needle 12 as will become apparent hereinafter. Piston 52 can be made from any machinable structural material; in a specific embodiment, piston 52 is made of aluminum.

Figure 4:
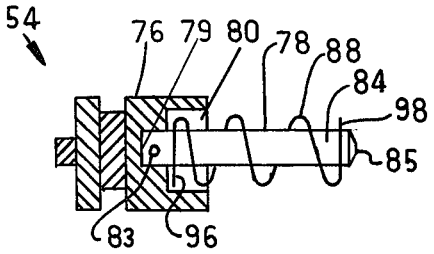
FIG. 4 is a cross-sectional view of the bottom pinch-off piston of the dispenser taken substantially along the section line 4—4 in FIG. 1.
Figure 5:
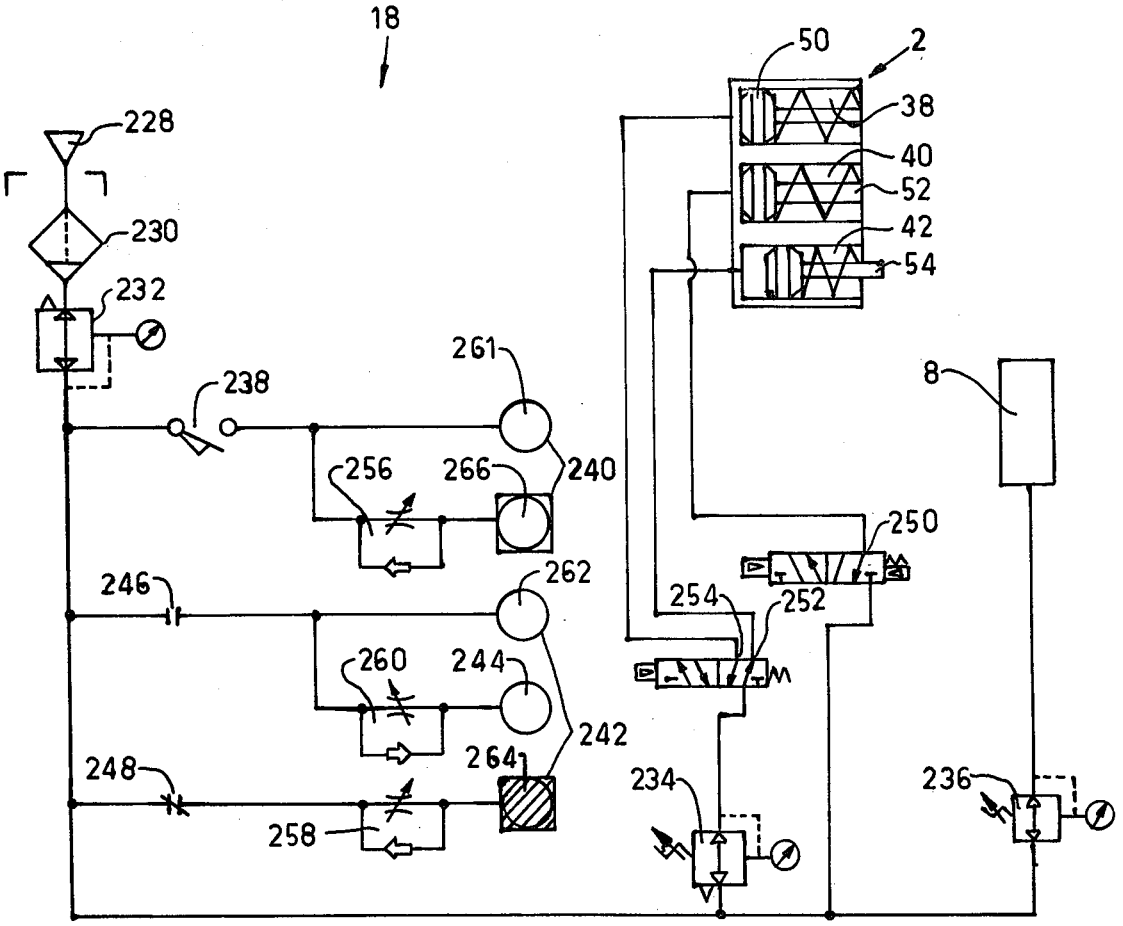
FIG. 5 is a schematic drawing of a control system for sequencing the operation of the improved dispenser of the invention.

Lower pinch-off piston 54 is similar to upper pinch-off piston 50, having a base 76 and a plunger 78. Piston 54 is movable axially within a cylinder 42 from a position 75 in which plunger 78 is positioned within cylinder 42 to a position 77 in which plunger 78 extends through opening 36 of pinch-off head 22 to compress the lower end 14 of pinch-off tube 6. As best seen in FIG. 4, plunger 78 has a blunt end 79 removably secured within the hollow portion 80 of base 76 by pin 81 inserted in hole 82 of base 76 and hole 83 of plunger 78 so that plunger 78 may be interchanged or replaced in base 76. The other end 84 of plunger 78 has a wedged shaped ram 85, so that forcing ram 85 against lower end 14 of pinch-off tube 6 stops the flow of material through tube 6 to needle 12. Both base 76 and plunger 78 can be made of any machinable structural material. In a specific embodiment, base 76 is made of aluminum, and plunger 78 is made of stainless steel.

Positioned within cylinders 38 and 42 are return springs 86 and 88, respectively. Spring 86 is coiled around plunger 58 of piston 50, having one end 90 thereof seated within hollow portion 61 of base 56 of piston 50 and the other end 92 resting against the inner end 94 of cylinder 38. In a like manner, spring 88 is coiled about plunger 78 of piston 54, having one end 96 thereof seated within hollow portion 80 of base 76 of piston 54 and the other end 98 resting against the inner end 100 of cylinder 42. In practice, springs 86 and 88 are operative to cause plungers 58 and 78 of pinch-off pistons 50 and 54, respectively, to be drawn back into cylinders 38 and 42, respectively, and to be positioned into positions 57 and 75 when control system 18 ceases the pinching off of tube 6.

Dispenser head body 20 further includes three spaced-apart holes 102, 104, and 106 in side 108 of body 20 for receiving and holding guide pins 110, 112, and 114, respectively. The length of pins 110, 112, and 114 is chosen so that pins 110, 112, and 114 barely extend into cylinders 38, 40 and 42, respectively. Bases 56, 70 and 76 of pistons 50, 52, and 54, respectively, are longitudinally scored or grooved on their respective outer surfaces 115, 116, and 117 so that pins 110, 112, and 114 will fit into grooves 118, 119, and 120, respectively, and thus prevent pistons 50, 52, and 54 from rotating or spiraling while moving axially within their respective cylinders 38, 40, and 42.

Base 24 of dispenser head 4 is removably mounted to surface 43 of body 20 screws 122 which are received in holes 123 of base 24 and holes 124 of body 20. Base 24 can be made of any machinable, structural material; in a specific embodiment, base 24 is made of aluminum. Base 24 includes displacement piston stop cylinder 125, shaft cylinder 126, air ports 128, 130, and 132, bracket bore 134, bracket slot 136, and set screw hole 138.

Displacement piston stop cylinder 125 extends within base 24 on the same axis as cylinder 40 between surface 140 of base 24 and the center 142 of base 24. At center 142, cylinder 125 intersects with shaft cylinder 126. Shaft cylinder 126 also extends within base 24 on the same axis as cylinder 40. Shaft cylinder 126 however extends between center 142 and surface 144. Surfaces 140 and 144 of base 24 are parallel to each other. With base 24 secured to body 20 by screws 122 and with displacement piston 52 fitted within cylinder 40, shaft 68 of piston 52 extends outwardly of body 20, through shaft cylinder 126, through displacement piston stop cylinder 125, and out opening 146 in surface 140 of base 24.

A displacement piston stop 148 is adjustably mounted about the threaded end 150 of shaft 68 so that stop 148 is positioned partially within displacement piston stop cylinder 125. An adjustment nut 152 is screwed about threaded end 150 of shaft 68 and snugged adjacent stop 148 in order to hold stop 148 in a selected position on shaft 68. In practice, stop 148 is axially movable within displacement piston stop cylinder 125 from a position 127 in which stop 148 on shaft 68 extends substantially outside cylinder 125 and base 70 of piston 52 abuts surface 144 of base 24 to a position 129 in which stop 148 is within cylinder 125 and inner end 154 of stop 148 abuts the bottom of cylinder 125. Thus, the position of stop 148 on shaft 68 of displacement piston 52 determines the length of the stroke of piston 52 and the amount of compression exerted by piston 52 on pinch-off tube 6. By these means, metered dispensing of accurate shots of a flowable material can be achieved. Displacement piston stop 148 is a partially hollowed cylinder that can be made of any solid and machinable structural material. In a specific embodiment, stop 148 is made of aluminum.

Positioned within displacement piston stop cylinder 125 of base 24 is a return spring 158. Spring 158 is coiled about the center portion 160 of shaft 68, having one end 162 of spring 158 seated within the hollow portion 164 of stop 148 and the other end 166 of spring 158 resting against the end wall 168 of cylinder 125. In practice, spring 158 is operative to cause displacement piston 52 to be drawn back into cylinder 40 of dispenser head body 20 and to be positioned into position 71 when control system 18 releases the compression of pinch-off tube 6 by displacement piston 52.

As stated above, dispenser head base 24 also includes air ports 128, 130 and 132 as well as bracket bore 134, bracket slot 136, and set screw hole 138. Ports 128, 130, and 132 have openings 170, 172 and 174 respectively, in surface 140 of base 24. The ports 128, 130 and 132 extend inwardly of base 24 with end portions 176, 178 and 180, respectively, being located in vertical spaced apart relationship near center 142 of base 24. Extending from ends 176, 178 and 180 to openings 182, 184 and 186 in opposite surface 144 of base 24 are lines 188, 190, and 192, respectively. Air lines 188, 190, and 192 provide separate paths for pressurized air to travel to cylinders 38, 40, and 42 respectively, in dispenser head body 20, and thus, operate pistons 50, 52 and 54 of squeezing mechanism 16 in response to control system 18.

In the upper end 194 of dispenser head base 24, there is located bracket bore 134, bracket slot 136, and set screw hole 138. Both bracket bore 134 and bracket slot 136 extend through upper end 194 in the same direction as displacement piston stop cylinder 125 and air ports 128, 130, and 132. Bracket slot 136 is positioned directly above bore 134 in a parallel spaced-apart relationship. Opening 196 of set screw hole 138 is located in surface 198 of dispenser head base 24. Set screw hole 138 is positioned perpendicular to slot 136 and passes through slot 136. A set screw 200 fits in hole 138 and can be turned within hole 138 so as to narrow slot 136 and thereby tighten or contract bore 134. Bracket bore 134 is typically dimensioned to receive varying sized rods of holding fixtures of the like (not shown). The turning of set screw 200 to narrow slot 136 and contract bore 134 will thereby tighten bracket 134 about the shaft of a holding device (not shown) fitted therein, and thus, secure dispenser 2 for subsequent operations.

As mentioned above, a flowable material reservoir 8 is connected to the upper end 10 of pinch-off tube 6. Reservoir 8 comprises a container 201, a cap or cover 202, and a coupling 204. In a specific embodiment, reservoir 8 is pressurized so as to provide a constant, even flow of material through pinch-off tube 6 and out dispensing needle 12. Cap 202 provides a vacuum tight seal to container 201 so that the pressure can be maintained therein. Coupling 204 serves to connect and seal lower end 206 of container 201 to the upper end 208 of pinch-off head 22 and upper end 10 of pinch-off tube 6, and thus maintain pressure in flowable material dispenser 2.

In a specific embodiment, an eylet 205 is positioned in the upper end 10 of tube 6 to cooperate with the pinch off head 22 and bore 30 to provide the appropriate seal between upper end 10 of pinch off tube 6 and pinch off head 22. (See FIGS. 1*a* and 1*b*). In a specific embodiment, the eyelet 205 can be secured to tube 6 by an appropriate adhesive.

At the lower end 14 of pinch off tube 6 is at least one dispensing needle 12. Needle 12 must also be connected and sealed to tube 6 in communication therewith in a manner to withstand the pressure in reservoir 8 and tube 6. To accomplish this purpose, needle 12 is provided with threads 209 at the upper end thereof and threads 209 are threadedly received in the lower end of bore 30 of pinch off head 22 (See FIG. 1).

In specific embodiments, the properties of the specific flowable material to be dispensed by the dispenser of the invention and the desired dispensed volume determine the size of the needle and the I.D. of pinch off tube 6. However, it has been found that with certain flowable materials, that the size of needle 12 is critical, and that too small or too large a needle 12 will cause the flowable dispenser of the invention to drool or drip; and therefore, not to be a dripless dispenser. In all such cases, it has been found that merely by substituting a needle 12 with a smaller I.D. (when the needle 12 is too large), or by substituting a needle 12 with a larger I.D., (when the needle 12 is too small) the dispenser of the invention can be made to function in a dripless manner in accordance with the invention in a total satisfactory way.

It has also been found that with certain flowable materials, a needle 12 having too small an I.D., may cause the dripless dispenser of the invention not to dispense any material, whatsoever. Again, it has been found that the dripless dispenser of the invention can be made to function properly in such cases merely by substituting a needle 12 with a larger I.D.

Referring now to FIGS. 1*a* and 1*b*, two different pinch off tubes 6 which can be used with the dispenser 2 of the invention are shown. With many flowable materials, the preferred pinch off tube 6 is that shown in FIG. 1*a* in which the tube 6 between the upper end 10 and the lower end 14 thereof has a generally uniform I.D. However, with other flowable materials used with dispenser 2, it has been found desirable to enhance the "snuff back" feature of the dispenser 2, while not interferring with the dispensed volume. In such cases, the preferred pinch off tube 6 is stepped diametered as shown in FIG. 1*b*. In this embodiment of pinch off tube 6, the upper portion of pinch off tube 6 which is in contact with plungers 58 and ram 72 in positions 59 and 73, respectively, is of a larger diameter than the lower portion of tube 6 which extends from just below the point of contact between ram 72 and tube 6 to the lower end 14 of tube 6. The upper and lower portions of tube 6 are both lengths of resilient tubing having a generally uniform diameter. In a specific embodiment, upper and lower tube portions are secured together with an appropriate adhesive.

Material flows from reservoir 8, through pinch-off tube 6, and out needle 12 to be accurately applied to a work surface. In order to keep dispensing needle 12 stationary, a pinch off needle guide 15 is provided. Pinch off needle guide 15 is an L-shaped strip of rigid sheet material that is secured to surface 210 of dispenser head body 20 in a manner so as to position the shorter leg or section 212 of guide 15 parallelly beneath dispenser head body 20. The holes 214 and 216 are provided in dispenser head body 20 for receiving screws 218 and 220 to secure guide 15 to body 20. Guide 15 has two holes 222 and 224 through which screws 218 and 220 are received so as to secure guide 15 to body 20. Guide 15 further includes a hole 226 in the shorter leg 212 dimensioned such that dispensing needle 12 may be slidably and snugly fitted therethrough. Hole 226 is axially aligned with bore 28 of dispenser head body 20, bore 30 of pinch off head 22, pinch off tube 6, and dispensing needle 12. Guide 15 holds dispensing needle 12 in a fixed position to facilitate accurate dispensing and placement of shots of a particular flowable material.

In a specific embodiment, a manifold (not shown) is provided having a plurality of needles 12 secured thereto. The manifold is secured to the bottom of body 20 and has an opening therein communicating with pinch off tube 6 and each needle 12.

In a specific embodiment, flowable material dispenser 2 is capable of dispensing uniformly measured shots of any flowable material. However, the shot size is variable and is determined by the relationship between the relative distances between pistons 50, 52, and 54, the diameter of pinch-off tube 6, and the length of the stroke of displacement piston 52. In the specific embodiment illustrated in the drawings, these dimensions of flowable material dispenser 2 are as follows:

Distance between the longitudinal axis of top pinch-off piston 50 and the longitudinal axis of displacement piston 52 = 0.875 inches Distance between the longitudinal axis of top pinch-off piston 50 and the longitudinal axis of bottom pinch-off piston 54 = 1.75 inches Distance between the longitudinal axis of displacement piston 52 and the longitudinal axis of bottom pinch-off piston 54 = 0.875

Diameter of pinch-off tube 6 = 0.062 to 0.187 I.D. inches

Length of stroke of displacement piston 52 = 0 to $\frac{3}{8}$ inch

Size of shot = 0.0005 to 0.025 cubic inches

The operation of flowable material dispenser 2 of the invention is controlled by control system 18. Control system 18 comprises dry air supply 228, filter 230, pressure regulators 232, 234, and 236, circuit making device or cycle valve 238, double pilot spring off/set actuators 240 and 242, single pilot spring off/set actuator 244, circuit making devices or flow valves 246, 248, 250, 252 and 254, cycle timer 256, delay 258, and snuff back timer 260.

In operation, control system 18 causes flowable material dispenser 2 to perform a sequence of operations. In the initial or rest condition of system 18, air supply 228 is turned on, pressure regulators 232, 234, and 236 are set, and bottom pinch-off piston 54 is forward in position 77 and engaged to pinch-off tube 6. Flow valve 246 is closed and flow valve 248 is made or open. Flow valve 252 is also made or open. Pressure regulator 232 regulates dispensed pressure; pressure regulator 234 regulates pinch-off pressure and pressure regulator 236 regulates reservoir pressure.

In a specific embodiment, pressure regulator 232 is set at about 60 psig, pressure regulator 234 is set at about 20–30 psig, and pressure regulator 236 is set at about 5–60 psig.

To start the cycle, cycle valve 238 is made and air is received by side 261 of double pilot spring off/set actuator 240. In response to receiving the air actuator 240 causes closed flow valve 246 to open and simultaneously causes the open flow valve 248 to close. Opening valve 246 allows air to flow to one side 262 of double pilot spring off/set actuator 242, but actuator 242 produces no immediate reaction or signal due to the equalization of pressure in actuator 242. However, opening valve 246 also allows air to flow to single pilot spring off/set actuator 244. Actuator 244 then simultaneously causes flow valve 252 to close and flow valve 254 to open, thereby releasing bottom pinch-off piston 54 from pinch-off tube 6 and moving the same to position 75, and moving top pinch-off piston 50 into position 59 and forcing top pinch-off piston 50 against tube 6. making cycle valve 238 also allows air to flow to cycle timer 256 thereby starting cycle timer 256. Closing flow valve 248 shuts off the air flow to the other side 264 of actuator 242, but actuator 242 remains pressurized at this time. However, shutting off the flow of air to side 264 of actuator 242 commences a gradual change in the pressure in actuator 242 due to a bleeding off of trapped air to the atmosphere, and thus, causes dispense delay 258 to start.

When dispense delay 258 times out, all of the air trapped in side 264 of actuator 242 has escaped or bled off to the atmosphere, causing an imbalance in pressure in double spring off/set actuator 242 due to the continued flow of air to side 262 of actuator 242. Accordingly, actuator 242 causes flow valve 250 to open, and displacement piston 52 is thereby forced against pinch-off tube 6. Both pinch-off piston 50 and displacement piston 52 are now forced against pinch-off tube 6. Pinch-off piston 50 has shut off the flow of material to tube 6 from reservoir 8, and displacement piston 52 has compressed pinch-off tube 6 to cause a portion of flowable material in tube 6 to be dispensed or forced out dispensing needle 12 at the lower end 14 of pinch-off tube 6.

Next, cycle timer 256 times out, and air can now flow to side 266 to actuator 240. Actuator 240 causes open flow valve 246 to close and simultaneously opens closed flow valve 248. Closing flow valve 246 cuts off the air flow to side 262 of double spring off/set actuator 244. Air which is now trapped in actuator 244 maintains pressure in actuator 244 for the time being so that actuator 244 produces no immediate response, but the trapped air starts to gradually bleed off to the atmosphere, and thus, causes snuff back timer 260 to start. Opening closed flow valve 248 allows air to flow to side 264 of actuator 242, which in turn causes flow valve 250 to close, releasing displacement piston 52 from pinch-off tube 6. With top pinch-off piston 50 still in position 59 and forced against upper end 10 of pinch-off tube 6, releasing displacement piston 52 allows middle portion 74 of resilient pinch-off tube 6 to open up and thus, draw or snuff back into middle portion 74 of tube 6 any residual amount of flowable material in pinch-off tube 6 or needle 12.

Finally, snuff back timer 260 times out due to the fact that air trapped in actuator 244 has escaped or bled off to the atmosphere. The lack of air pressure on actuator 244 causes actuator 244 to close flow valve 254 and open flow valve 252 so as to position top pinch-off piston 50 in position 59 and to release the same from upper end 10 of pinch-off tube 6, and to move bottom pinch-off piston 54 to position 77 and to force piston 54 against lower end 14 of pinch-off tube 6. Material in reservoir 8 can now flow into pinch-off tube 6. filling tube 6 for the next dispensing operation. The full cycle is then completed by releasing cycle valve 238. The flowable material dispenser 2 has thus returned to its initial or rest condition awaiting the making of cycle valve 238 to start another identical cycle.

While the control system 18 has been described above as a pneumatic system, control system 18 can also be hydraulic or electrical. A hydraulic control system 18 would comprise a fluid supply analogous to supply 228, pressure regulators analogous to regulators 232, 234 and 236, valves analogous to valves 238, 246, 248, 250, 252 and 254, actuators analogous to actuators 240, 242 and 244, and timers and delays analogous to timers 256 and 260 and delay 258.

Figure 6:
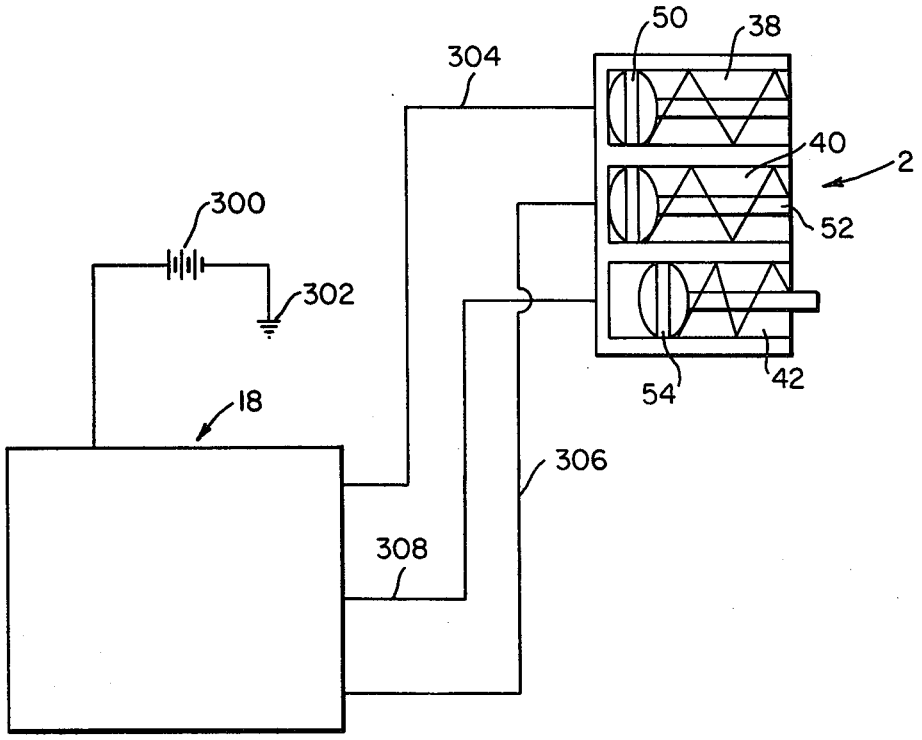
FIG. 6 is a diagrammatic illustration of an alternate control system for sequencing the operation of the improved dispenser of the invention.

FIG. 6 illustrates an electrical system 18. Operatively connected to this system is a voltage supply 300 which is grounded at 302. Electrical system 18 comprises voltage regulators analogous to regulators 232, 234, and 236, switches analogous to circuit making devices or valves 238, 246, 248, 250, 252, and 254, motors or solenoids analogous to actuators 240, 242 and 244, and timers and delay circuits analogous to timers 256 and 260 and delays 258. Electrical system 18 is operatively connected to dispenser 2 and the pistons 50, 52 and 54.

The improved dripless flowable material dispenser of the invention provides extremely accurate dispensing of measured shots. The dispenser is capable of dispensing various volumes of a flowable material ranging from a fraction of a drop to approximately 15 drops. Because of ease in maintenance and material changeover and limited adjustments during operation, overall convenience and efficiency of operation are enhanced. The dispenser employs an improved method of dispensing which eliminates post-dispensing drippage, produces uniformly sized shots despite changes in the viscosity of the particular material being dispensed, and accommodates a wide range of viscosities, for example, about 10 to about 200,000 cps.

The term "flowable material" is used herein to refer to any material which is flowable through the pinch off tube 6 under the pressure exerted on the material at the temperature of the material. Such flowable materials may be either liquids or powders and may be flowable or non-flowable at atmospheric pressure and room temperature. Many non-flowable materials at atmospheric pressure and in room temperature become flowable materials and may be used with the dispenser 2 of the invention at elevated temperatures and pressures.

While there have been described above the principles of this invention in connection with specific apparatus, it is to be clearly understood that this description is made only by way of example and not as a limitation to the scope of the invention.

What is claimed is:

1. A dropless flowable material dispenser for dispensing measured amounts of a flowable material from a pressurized flowable material reservoir comprising a resilient pinch off tube having opposite ends and means for removably coupling said tube to said reservoir at one end thereof, nozzle means removably coupled to the other end of said pinch off tube, said nozzle means being in communication with said reservoir through said tube and means for selectively squeezing said tube to force a selected amount of said material out of said tube and nozzle means and to draw any residual amount of said material in said nozzle means back away from the distal end thereof, said squeezing means including a plurality of rams, each of said rams being selectively movable from a first position in which said ram is disengaged from said tube to a second position in which said ram engages and compresses said tube, said plurality of rams including an upper ram and an intermediate ram and a lower ram, said squeezing means further including means for moving said rams and means for sequencing the movement of said rams to fill said tube with said material by positioning said lower ram in said second position thereof, positioning said upper and intermediate rams in said first position thereof, and allowing said material to flow into said tube from said reservoir, to isolate said material in said tube by positioning said upper and lower rams in said second position thereof, and to dispense a portion of said material in said tube and to draw any residual of said material left in said tube from the distal end of said nozzle means by positioning said upper ram in said second position thereof, said lower ram in said position thereof, squeezing said tube by moving said intermediate ram from said first position thereof toward said second position thereof, and moving said intermediate ram to said first position thereof after dispensing the desired amount of said material from said tube.

2. The dispenser of claim 1 wherein said nozzle means includes a dispensing needle, means for coupling said needle to said tube.

3. The dispenser of claim 1 wherein said moving of said upper ram into said second position thereof in said isolating step and said lower ram into said first position thereof in said dispensing step, respectively, is simultaneous, and further comprising the step of simultaneously positioning said lower ram in said second position thereof and said upper ram in said first position thereof after said drawing back of said residual of said isolated material.

4. The dispenser of claim 1 wherein said sequencing means includes an energy source coupled to a circuit, said source providing a flow of energy throughout said circuit, a plurality of regulators connected to and positioned along said circuit, each of said regulators separately regulating the flow of energy through said circuit, a first plurality of circuit making devices connected to and positioned along said circuit, said making devices selectively permitting and stopping said flow of energy through said circuit, a plurality of timers and actuators connected to and positioned along said circuit, said actuators being operatively coupled to said first plurality of making devices, respectively, thereby to receive said flow of energy through said first plurality of making devices, a second plurality of circuit making devices, said actuators being operatively connected to said second plurality of circuit making devices, said timers being operatively connected to said actuators, whereby said timers sequence the operation of said second plurality of circuit making devices, said second plurality of circuit making devices being operatively connected to said rams, respectively.

5. The dispenser of claim 4 wherein said energy source includes a pressurized fluid source, said source providing a flow of fluid throughout said circuit, wherein said regulators are pressure regulators to control the amount of pressure being exerted on said fluids, and wherein said circuit making devices are flow valves.

6. The dispenser of claim 4 wherein said energy source includes a voltage source, said circuit is an electrical circuit, said regulators are voltage regulators, said circuit making devices and actuators are switches, and said moving means are chosen from the group consisting of motors and solenoids.

7. The dispenser of claim 1 wherein the said pinch off tube is a step diametered tube, said tube portions adjacent said one end having an interior portion diameter larger than the interior diameter of said tube adjacent said other end thereof, each said tube portion having generally uniform interior diameters, said upper and intermediate ram engaging said upper portion of said tube, said lower ram engaging said lower portion of said tube.

8. The dispenser of claim 1 further comprising a plurality of operators, there being an operator for each of said rams, said operators being connected to said rams, respectively, an energy source, said energy source being operatively connected to each of said operators, each of said operators being also operatively connected to said sequencing means.

9. The dispenser of claim 8 wherein each of said operators is a piston, and wherein said energy source includes a plurality of springs and a pressurized fluid, said fluid being in operable communication with each of said pistons, one of said springs being operatively connected to each of said pistons in opposition to the force of said fluid against said piston.

10. The dispenser of claim 9 wherein said sequencing means includes a circuit, said energy source being coupled to said circuit and providing a flow of energy throughout said circuit, a plurality of regulators connected to and positioned along said circuit, each of said regulators separately regulating the flow of energy through said circuit, a first plurality of circuit making devices connected to and positioned along said circuit, said making devices selectively permitting and stopping said flow of energy throughout said circuit, a plurality of timers and actuators connected to and positioned along said circuit, said actuators being operatively coupled to said first plurality of making devices, respectively, thereby to receive said flow of energy through said first plurality of making devices, a second plurality of circuit making devices, said actuators being operatively connected to said second plurality of circuit making devices, said timers being operatively connected to said actuators, whereby said timers sequence the operation of said second plurality of circuit making devices, said second plurality of circuit making devices being operatively connected to said rams, respectively.

11. The dispenser of claim 10 wherein said energy source includes a pressurized fluid source, said source providing a flow of fluid throughout said circuit, wherein said regulators are pressure regulators to control the amount of pressure being exerted on said fluids, and wherein said circuit making devices are flow valves.

12. The dispenser of claim 1 further including a body housing said squeezing means, a bore in said body, a pinch off head removably fitted in said bore, said pinch off head having a bore extending therethrough, said tube being removably positioned in said pinch off head bore, a base connected to said body, said base including a means for securing said base and said body connected thereto to auxiliary apparatus.

13. The dispenser of claim 1 wherein said pinch off tube has a generally uniform interior diameter between said opposite ends, and said tube reservoir coupling means includes a rigid tubular end piece fastened to said tube at said one end.

14. The dispenser of claim 1 wherein said pinch off tube is a step diametered tube, said tube portions adjacent said one end having an interior diamater larger than the interior diameter of said tubular portion adjacent said other end thereof, each said tube portion having generally uniform interior diameters.

15. The method of dispensing selected amounts of a flowable material from a pressurized flowable material reservoir having a resiliently expandible and compressible tube communicating therewith, the pinching off of said tube stopping the flow of said material through said tube and the releasing of said pinching off of said tube allowing said tube to resiliently expand and said material to flow through said tube, said tube having a dispensing end, comprising the steps of: pinching off said tube adjacent to said dispensing end, releasing said tube between said reservoir and said pinching off, allowing said material in said reservoir to flow into said tube, thereby filling said tube with said material, pinching off said tube adjacent to said reservoir and said dispensing end thereby isolating said material within said tube from said reservoir, releasing said pinching off of said tube adjacent to said dispensing end, and squeezing said tube between said pinching off adjacent to said reservoir and said dispensing end, thereby dispensing a portion of said material from said tube, releasing said squeezing of said tube thereby drawing any residual amount of said material in said tube back away from said dispensing end thereof.

16. The method of claim 15 wherein said pinching off of said tube adjacent to said reservoir and said releasing of said pinching off of said tube adjacent to said dispensing end are accomplished simultaneously.

17. The method of claim 17 wherein said pinching off of said tube adjacent to said dispensing end and said releasing of said pinching off of said tube between said reservoir and said pinching off adjacent to said dispensing end are accomplished simultaneously.

18. A dripless flowable material dispenser for dispensing measured amounts of a flowable material from a pressurized flowable material reservoir comprising a resilient pinch off tube having opposite ends and means for removably coupling said tube to said reservoir at one end thereof, nozzle means removably coupled to the other end of said pinch off tube, said nozzle means being in communication with said reservoir through said tube and means for selectively squeezing said tube to force a selected amount of said material out of said tube and nozzle means and to draw any residual amount of said material in said nozzle means back away from the distal end thereof, said squeezing means including a plurality of rams, each of said rams being selectively movable from a first position in which said ram is disengaged from said tube to a second position in which said ram engages and compresses said tube, said plurality of rams including an upper ram and an intermediate ram and a lower ram, said squeezing means further including means for moving said rams and means for sequencing the movement of said rams to dispense a portion of said material in said tube by positioning said upper ram in said second position thereof and said intermediate ram in said first position thereof and said lower ram in said first position thereof and squeezing said tube by moving said intermediate ram from said first position thereof toward said second position thereof and to draw any residual of said material left in said tube from the distal end of said nozzle means by returning said intermediate ram to said first position thereof after dispensing the desired amount of said material from said tube while maintaining said upper and lower rams in said second and first positions thereof, respectively.

* * * * *